US007636526B2

(12) United States Patent
Murakami

(10) Patent No.: US 7,636,526 B2
(45) **Date of Patent: *Dec. 22, 2009**

(54) IMAGE FORMING APPARATUS AND CONTROL METHOD THEREOF

(75) Inventor: Reiji Murakami, Yokohama (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 322 days.

This patent is subject to a terminal disclaimer.

(21) Appl. No.: 11/687,086

(22) Filed: Mar. 16, 2007

(65) Prior Publication Data

US 2008/0225318 A1 Sep. 18, 2008

(51) Int. Cl.
*G03G 15/00* (2006.01)
*G03G 15/16* (2006.01)

(52) U.S. Cl. ..... 399/45; 399/16; 399/23; 399/66; 399/389

(58) Field of Classification Search ..... 399/16, 399/45, 367, 369, 372, 50, 51, 53, 66, 391, 399/393, 23, 389
See application file for complete search history.

(56) References Cited

U.S. PATENT DOCUMENTS

2005/0078973 A1* 4/2005 Suzuki ..... 399/45
2006/0045547 A1* 3/2006 Aiyama ..... 399/16
2008/0225318 A1* 9/2008 Murakami ..... 358/1.12

FOREIGN PATENT DOCUMENTS

JP 2004-277057 10/2004

* cited by examiner

*Primary Examiner*—David M Gray
*Assistant Examiner*—Joseph S Wong
(74) *Attorney, Agent, or Firm*—Turocy & Watson, LLP

(57) ABSTRACT

An image forming apparatus of the invention conveys paper fed by a paper feeding mechanism piece by piece to a paper discharging unit through a paper conveying path. An image forming unit is arranged in a midway portion of this paper conveying path and executes an image forming process for printing an image based on image data on paper being conveyed. A sensor that detects a type of the paper conveyed is arranged on an upstream side with respect to the image forming unit on the paper conveying path. Image forming process conditions for the image forming unit are set in accordance with a detection result of the sensor. When the paper fed is paper not detected by the sensor, the image forming process is not started. After paper type detection by the sensor, the paper is directly discharged. When the paper fed is paper of the same type as paper detected by the sensor, the image forming process is started without performing paper type detection. Moreover, paper being conveyed is conveyed to the image forming unit, in which the image forming process is started, in synchronization with a printing operation of the image forming unit.

8 Claims, 3 Drawing Sheets

IMAGE FORMING APPARATUS AND CONTROL METHOD THEREOF

BACKGROUND OF THE INVENTION

1. Field of the Invention

The present invention relates to image forming apparatuses that can print characters and figures on various kinds of paper such as a printer and a copying machine.

2. Description of the Related Art

In general, in this type of image forming apparatuses, printing on various kinds of paper having different thicknesses and the like is possible. However, a difference in a paper type affects transferability, fixability, and the like in printing. Therefore, for example, in an image forming apparatus of an electrophotographic system, improvement in an image quality is realized by, for example, changing a quantity of toner for transferring an image to paper, transfer conditions, and fixing conditions according to paper thickness.

Conventionally, an operator visually checks and manually designates paper type information such as thickness. However, for example, because this work is extremely complicated, it is proposed to automatically detect a paper type using a transmission optical sensor or the like.

For example, in JP-A-2004-277057, paper feeding mechanism that feeds paper piece by piece is provided for each paper feeding cassette that stacks and holds paper and, on an outgoing side of the paper feeding mechanism, a paper type sensor that detects type (thickness, etc.) of paper fed by this paper feeding mechanism is provided. In preparation for printing to be performed later, a leading end of one piece of paper at the top is fed from the paper feeding cassette by a predetermined quantity by the paper feeding mechanism at timing prior to an original paper feeding command and a type of the paper is detected by the paper type sensor.

In this way, it is possible to acquire paper type information at the timing prior to the original paper feeding command. This makes it possible to perform, for an image forming process of an image forming unit, proper setting using the detected paper type information before the original paper feeding command for printing is received.

In this type of image forming apparatuses, in general, plural paper feeding cassettes as paper supplying sources are provided. Pieces of paper of types different from one another are often provided in the plural paper feeding cassettes, respectively, to make it possible to select a desired paper type from these paper feeding cassettes and perform printing. In this case, pieces of paper fed from the respective paper feeding cassettes by paper feeding mechanisms are separately sent to a common paper conveying path leading to the image forming unit, and sent to the image forming unit and printed, respectively.

A case in which the conventional technique described above is applied to such image forming apparatuses will be examined. For example, it is assumed that paper is stored in a paper feeding cassette and the paper feeding cassette is set in an image forming apparatus main body. In this case, to detect a paper type in advance in preparation for printing after this, as described above, a leading end of one piece of paper is fed from the paper feeding cassette by a predetermined quantity by the paper feeding mechanism and a type of the paper is detected by the paper type sensor. Thereafter, if an original paper feeding command for the paper, the type of which is detected, is continuously issued, no problem occurs because it is possible to send the paper fed halfway to the image forming unit as it is. However, if an original paper feeding command for paper stored in another paper feeding cassette is issued, it is likely that the paper, the type of which is detected, hinders feeding and conveyance of the paper according to the original paper feeding command.

In short, in the image forming apparatus having the plural paper feeding cassettes, it is not definitely decided to which one of the paper feeding cassettes (paper types) an original paper feeding command is given. The paper feeding cassette is changed according to a print request. Therefore, as described above, it often occurs that, after a paper type of a paper feeding cassette set anew is detected, an original paper feeding command is given to another paper feeding cassette.

In this case, since the paper, the type of which is detected, stays in a state in which the leading end thereof is fed by the predetermined quantity, it is likely that the paper hinders movement of paper fed from another paper feeding cassette to a common conveying path. To prevent the paper from hindering the movement of another piece of paper, it is necessary to provide the paper type sensor in an extremely narrow portion near the paper feeding mechanism and arrange and set the paper type sensor such that the leading end of the paper in the type detected state does not project over the conveying path of another piece of paper. Therefore, the paper type sensor is subjected to restriction in terms of arrangement. Even if the paper type sensor is arranged in this way, when a quantity of paper feeding by the paper feeding mechanism is unstable, the leading end may project to the common conveying path and interfere with the movement of another piece of paper. When double feeding occurs, remaining paper may project to the common conveying path.

To surely prevent such interference, paper once fed to the sensor portion only has to be returned into the paper feeding cassette after the detection by the sensor.

However, to return the paper partially fed from the paper feeding cassette into the paper feeding cassette after the paper type detection, a complicated mechanism is required, which causes a failure. It is not preferable to return the paper once fed because a burden on the paper is heavy and a jam is caused.

Providing the paper type sensor near the paper feeding mechanism leads to misdetection of a paper type as well. The paper feeding mechanism takes out uppermost paper stacked and held in the paper feeding cassette with a pickup roller and separates and feeds the paper piece by piece with a paper feeding roller arranged on a front surface side of the paper and a separation roller arranged on a rear surface side of the paper. However, when a separating action is not sufficient, two pieces of paper may be delivered together right behind the paper feeding roller and the separation roller. Even if the two pieces of paper are delivered together, in most cases, only one piece of paper is delivered to the conveying path by an action of the separation roller. However, when the paper type sensor is provided near the separation and paper feeding mechanisms, the paper type sensor detects these two pieces of paper. Thus, for example, in the case of a sensor that detects paper thickness, misdetection is caused.

SUMMARY OF THE INVENTION

It is an object of the invention to provide an image forming apparatus that can perform printing under optimum conditions according to a paper type and without deteriorating performance because the image forming apparatus performs paper feeding for detecting a paper type prior to original paper feeding and, after the detection of the paper type, sends paper in a state in which the paper does not hinder conveyance of another piece of paper and prepares for the original paper feeding after that.

According to an aspect of the invention, an image forming apparatus includes: a paper feeding mechanism that feeds paper piece by piece; a paper conveying path that conveys, when paper is fed by this paper feeding mechanism, the paper to a paper discharging unit; an image forming unit that is arranged between the paper feeding mechanism and the paper discharging unit on this paper conveying path and executes an image forming process for printing an image based on image data on the paper being conveyed by the paper conveying path; a sensor that is arranged on an upstream side with respect to the image forming unit on the paper conveying path and detects a type of paper conveyed by this paper conveying path; a condition setting unit that sets conditions for an image forming process of the image forming unit in accordance with a value detected by this sensor; an image-forming-process control unit that does not start the image forming process when paper fed to the paper conveying path by the paper feeding mechanism is paper not detected by the sensor and starts the image forming process without awaiting paper type detection when paper fed to the paper conveying path is detected by the sensor; and a paper-conveying-path control unit that causes, when paper fed to the paper conveying path is paper not detected by the sensor, the paper conveying path to discharge the paper through the image forming unit, in which the image forming process is not started, and causes, when paper fed to the paper conveying path is paper of a type same as paper detected by the sensor, the paper conveying path to convey the paper to the image forming unit, in which the image forming process is started, in synchronization with a printing operation of the image forming unit.

According to another aspect of the invention, an image forming apparatus includes: a paper feeding mechanism that feeds paper piece by piece; a main paper conveying path that conveys, when paper is fed by this paper feeding mechanism, the paper to a paper discharging unit; an image forming unit that is arranged between the paper feeding mechanism and the paper discharging unit on this main paper conveying path and executes an image forming process for printing an image based on image data on the paper being conveyed by the main paper conveying path; a sensor that is arranged on an upstream side with respect to the image forming unit on the main paper conveying path and detects a type of paper conveyed by this main paper conveying path; a sub paper conveying path that is divided from a downstream side with respect to the image forming unit on the main paper conveying path, joins with the upstream side with respect to the image forming unit on the main paper conveying path, and, in operation, switches back paper conveyed from the image forming unit to the paper discharging unit and joins the paper to the upstream side of the image forming unit; a condition setting unit that sets conditions for an image forming process of the image forming unit in accordance with a value detected by this sensor; an image-forming-process control unit that does not start the image forming process when paper fed to the main paper conveying path by the paper feeding mechanism is paper not detected by the sensor and starts the image forming process according to the paper feeding to the main paper conveying path when paper fed to the paper conveying path is paper of a type same as paper detected by the sensor; and a paper-conveying-path control unit that conveys, when paper fed to the main paper conveying path is paper not detected by the sensor, the paper to the sub paper conveying path, starts the image forming process, and causes the sub paper conveying path to convey the paper conveyed through the sub conveying path to the image forming unit, in which the image forming process is started, in synchronization with a printing operation of the image forming unit and causes, when paper fed to the paper main conveying path is paper of a type same as paper detected by the sensor, the main paper conveying path to convey the paper to the image forming unit, in which the image forming process is started, in synchronization with a printing operation of the image forming unit.

According to still another aspect of the invention, a control method of an image forming apparatus includes: a step of feeding paper piece by piece to a main paper conveying path that conveys fed paper to a paper discharging unit; a step of detecting a type of the paper fed to the main paper conveying path with a sensor; a step of setting, in accordance with a detection result of the sensor, image forming process conditions for an image forming unit that executes an image forming process for forming an image based on image data and printing the image on paper being conveyed by the paper conveying path; a step of not starting the image forming process when paper fed to the paper main conveying path is paper, a type of which is not detected by the sensor, passing the paper through the image forming unit, in which this image forming process is not started, actuating a sub paper conveying path that is divided from an exit side of this image forming unit and joins with an upstream side with respect to the image forming unit of the main paper conveying unit, switching back paper conveyed from the image forming unit to the paper discharging unit, joining the paper to the upstream side of the image forming unit, starting the image forming process, and conveying the paper to the image forming unit in synchronization with printing timing of the image forming unit; and a step of starting the image forming process without performing paper type detection when paper fed to the main paper conveying path is paper of a type same as type detected by the sensor and causing the main paper conveying path to convey the paper to the image forming unit in synchronization with a printing operation of the image forming unit.

DETAILED DESCRIPTION OF THE INVENTION

Embodiments of the invention will be hereinafter explained in detail with the accompanying drawings as examples.

Figure 1:
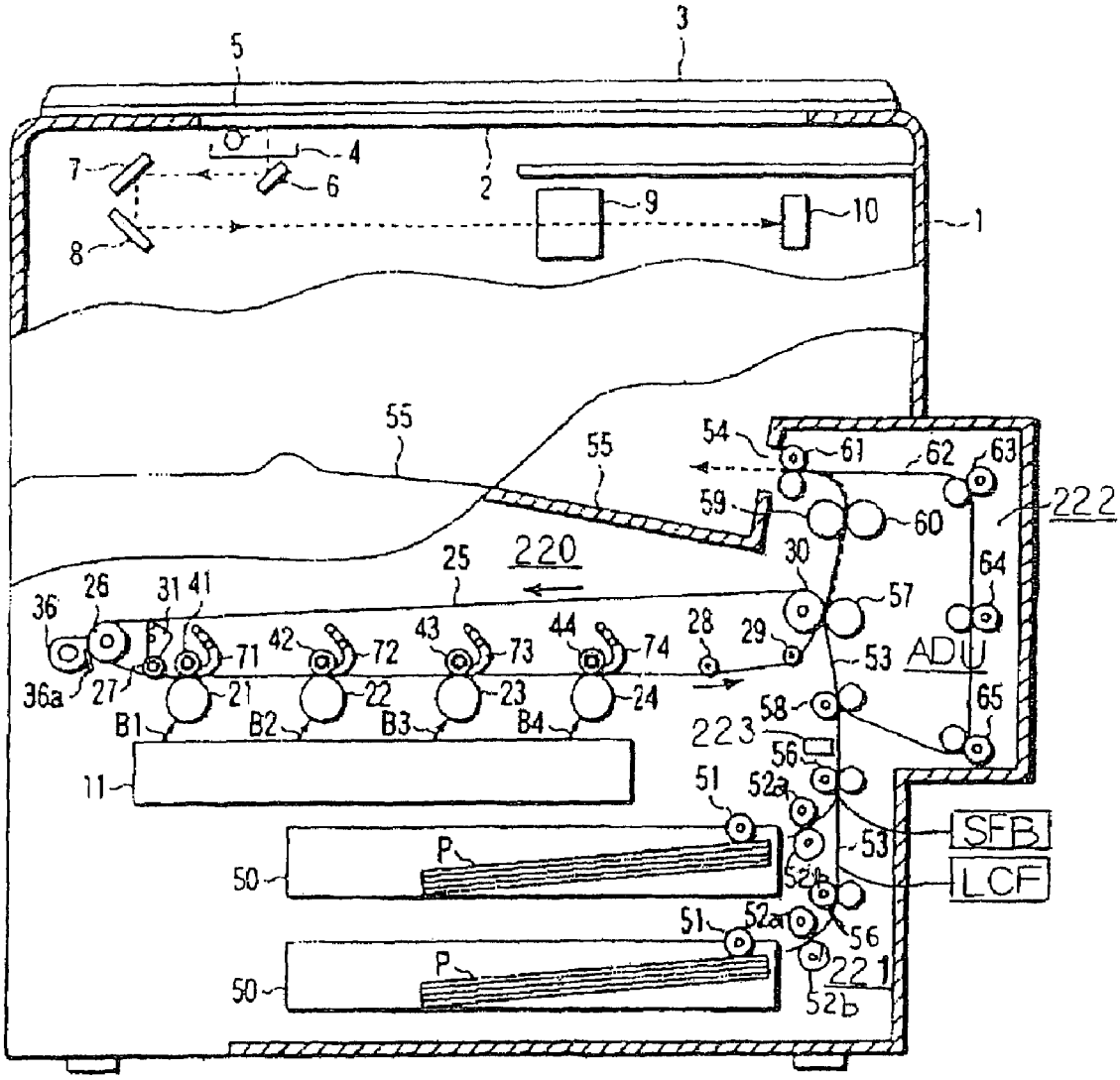
FIG. 1 is a diagram showing an overall structure of an image detecting apparatus according to a first embodiment of the invention.
Figure 2:
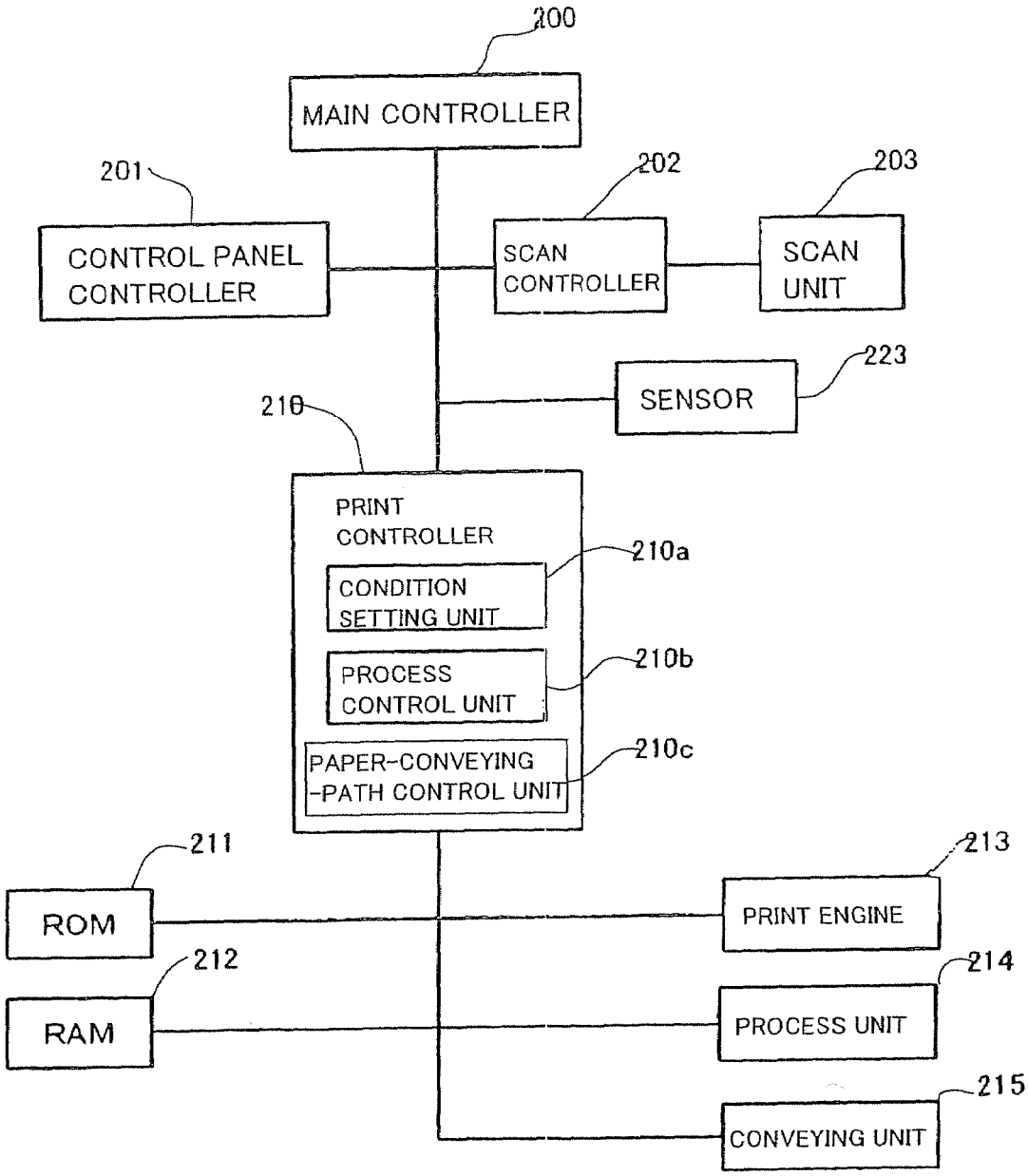
FIG. 2 is a functional block diagram for explaining a control unit of the image detecting apparatus according to the first embodiment of the invention.

FIG. 1 shows a structure of an image forming apparatus according to a first embodiment of the invention. FIG. 2 shows control unit of the image forming apparatus as functional blocks. In FIG. 1, reference numeral 1 denotes an apparatus main body. A transparent original stand (a glass plate) 2 for placing an original is provided in an upper part of the apparatus main body 1. A cover 3 is provided on this original stand 2 to be freely opened and closed. A carriage 4 is provided on a lower surface side of the original stand 2. An exposure lamp 5 is provided in the carriage 4. The carriage 4 is capable of reciprocatingly moving along the lower surface of the original stand 2. This carriage 4 reciprocatingly moves while lighting the exposure lamp 5 to expose an original on the original stand 2. A reflected light image of the original placed on the original stand 2 is obtained by this exposure. The reflected light image is projected on a CCD (Charge Coupled Device) 10 by reflecting mirrors 6, 7, and 8 and a lens block for magnification 9. The CCD 10 outputs an image signal corresponding to the reflected light image of the original.

A scan unit (203 in FIG. 2) that optically scans an image of the original placed on the original stand 2 is constituted by the carriage 4, the exposure lamp 5, the reflecting mirrors 6, 7, and 8, the lens block for magnification 9, and the CCD 10.

Reference numeral 220 denotes an image forming unit, which is constituted by a print engine (213 in FIG. 2) constituted by an exposing unit 11 and the like, photoconductive drums 21, 22, 23, and 24, a transfer belt 25, a drive roller 26, and a process unit (214 in FIG. 2) constituted by a transfer-roller driving unit and the like. This image forming unit 220 forms an image based on image data (the image signal outputted from the CCD 10) and executes an image forming process for printing the image on paper being conveyed. The image signal outputted from the CCD 10 is supplied to the exposing unit 11 first after being appropriately processed. The exposing unit 11 emits a laser beam B1 corresponding to an image signal of a yellow color, a laser beam B2 corresponding to an image signal of a magenta color, a laser beam B3 corresponding to an image signal of a cyan color, and a laser beam B4 corresponding to an image signal of a black color to a photoconductive drum 21 for the yellow color, a photoconductive drum 22 for the magenta color, a photoconductive drum 23 for the cyan color, and a photoconductive drum 24 for the black color, respectively.

The photoconductive drums 21, 22, 23, and 24 are arrayed substantially in the horizontal direction at fixed intervals. The transfer belt 25 of an endless shape is provided above these photoconductive drums 21, 22, 23, and 24. The transfer belt 25 is laid over the drive roller 26, guide rollers 27, 28, and 29, and a driven roller 30. The transfer belt 25 is subjected to power from the drive roller 26 and rotates to travel in a counterclockwise direction. The guide roller 27 is provided to move up and down freely. The guide roller 27 is subjected to rotation of a cam 31 and moved to the transfer belt 25 side to displace the transfer belt 25 to the photoconductive drums 21, 22, 23, and 24 side.

Primary transfer rollers 41, 42, 43, and 44 are provided to be movable up and down in positions opposed to the photoconductive drums 21, 22, 23, and 24 across the transfer belt 25. The primary transfer rollers 41, 42, 43, and 44 are moved (lowered) to the transfer belt 25 side to bring the transfer belt 25 into contact with the photoconductive drums 21, 22, 23, and 24 and transfer visible images on the photoconductive drums 21, 22, 23, and 24 to the transfer belt 25.

Although not shown in the figure, a cleaner, a charge removing lamp, a charging unit, and a developing unit are displayed one after another around the photoconductive drum 21 (and the other photoconductive drums 22, 23, and 24 as well). The cleaner has a cleaning blade, which comes into contact with the surface of the photoconductive drum 21, and scrapes off a developing material remaining on the surface of the photoconductive drum 21 with the cleaning blade. The charge removing lamp removes electric charges remaining on the surface of the photoconductive drum 21. The charging unit applies a high voltage to the photoconductive drum 21 to charge the surface of the photoconductive drum 21 with electrostatic charges. The laser beam B1 emitted from the exposing unit 11 is irradiated on the surface of the photoconductive drum 21 subjected to the charging. An electrostatic latent image is formed on the surface of the photoconductive drum 21 by this irradiation. The developing unit supplies a developing material (a toner) of the yellow color to the surface of the photoconductive drum 21 to visualize the electrostatic latent image on the surface of the photoconductive drum 21.

Plural paper feeding cassettes 50 as paper supplying sources are provided below the exposing unit 11. A large number of pieces of paper P of types different from one another are stored in these paper feeding cassettes 50 in a stacked state. Paper feeding mechanisms 221 that feed the paper in the paper feeding cassettes 50 piece by piece from the top are provided in exit portions (on the right side in the figure) of these paper feeding cassettes 50, respectively. The paper P is taken out piece by piece from any one of the paper feeding cassettes 50 by this paper feeding mechanism 221. This paper feeding mechanism 221 for taking out paper is constituted by a pickup roller 51, a paper feeding roller 52*a*, and a separation roller 52*b*. The paper feeding mechanism 221 separates the paper P taken out from the paper feeding cassette 50 and feeds the paper to a paper conveying path 53 piece by piece.

The paper conveying path 53 extends to a paper discharge port 54 above through the driven roller 30 of the image forming unit 220. The paper discharge port 54 faces a paper discharging unit 55 leading to an outer peripheral surface of the main body 1. Conveying rollers 56 are provided near the paper feeding mechanisms 221, respectively, on a start end side of the paper conveying path 53. When paper is fed to this paper conveying path 53 by any one of the paper feeding mechanisms 221, the paper conveying path 53 conveys the paper fed to the paper discharging unit 55.

A secondary transfer roller 57 is provided, across the transfer belt 25, in a position opposed to the driven roller 30 in a midway portion of the paper conveying path 53. Registration rollers 58 are provided in a position before the driven roller 30 and the secondary transfer roller 57 in a conveying direction. The registration rollers 58 deliver the paper P into a space between the transfer belt 25 and the secondary transfer roller 57 at timing synchronizing with a transfer operation by the transfer belt 25 and the secondary transfer roller 57. The secondary transfer roller 57 transfers, while nipping the paper P delivered from the registration rollers 58 between the secondary transfer roller 57 and the transfer belt 25 on the driven roller 30, a visible image transferred on the transfer belt 25 to the paper P and prints the visible image on the paper P. In other words, the registration rollers 58 convey the paper P to the image forming unit 220 having the transfer belt 25 and the secondary transfer roller 57 in synchronization with a printing operation of the image forming unit 220.

A heat roller 59 for heat fixing and a press-contact roller 60 in contact with this heat roller 59 are provided in a position of the paper conveying path 53 further on a downstream side than the secondary transfer roller 57. The image transferred to the paper P is fixed by the heat roller 59 and the press-contact roller 60. A paper discharging roller 61 is provided at an end of the paper conveying path 53.

Reference numeral 222 denotes an automatic duplex unit (hereinafter referred to as ADU). The ADU 222 has a paper conveying path 62 that is divided from a downstream side with respect to the image forming unit 220 on the paper conveying path 53 (the end of the conveying path 53) and joins with an upstream side with respect to the image forming unit 220 on the paper conveying path 53 (an upstream side position of the registration rollers 58). This paper conveying path 62 reverses the front and the back of the paper P for duplex printing. The paper conveying path 62 is provided with the conveying rollers 63, 64, and 65 and, in operation, switches back paper conveyed from the image forming unit 220 to the paper discharging unit 55 and joins the paper to the upstream side of the image forming unit 220. In this way, the paper P returned to the upstream side of the image forming unit 220 by the paper conveying path 62 joins with the paper conveying path 53. The paper P is delivered to the image forming unit 220 by the registration rollers 58 in synchronization with a printing operation of the image forming unit 220. Therefore, the visible image on the transfer belt 25 is transferred to the rear surface of the paper P and printed.

The paper conveying path 53 that conveys the paper fed by the paper feeding mechanism 221 to the paper discharging unit 55 is set as a main paper conveying path and the paper conveying path 62 for reversing the front and the back of the paper is set as a sub paper conveying path. This sub paper conveying path 62 comes into the operation state described above when the duplex printing is designated by a not-shown control panel or the like provided in the apparatus main body 1.

Figure 3:
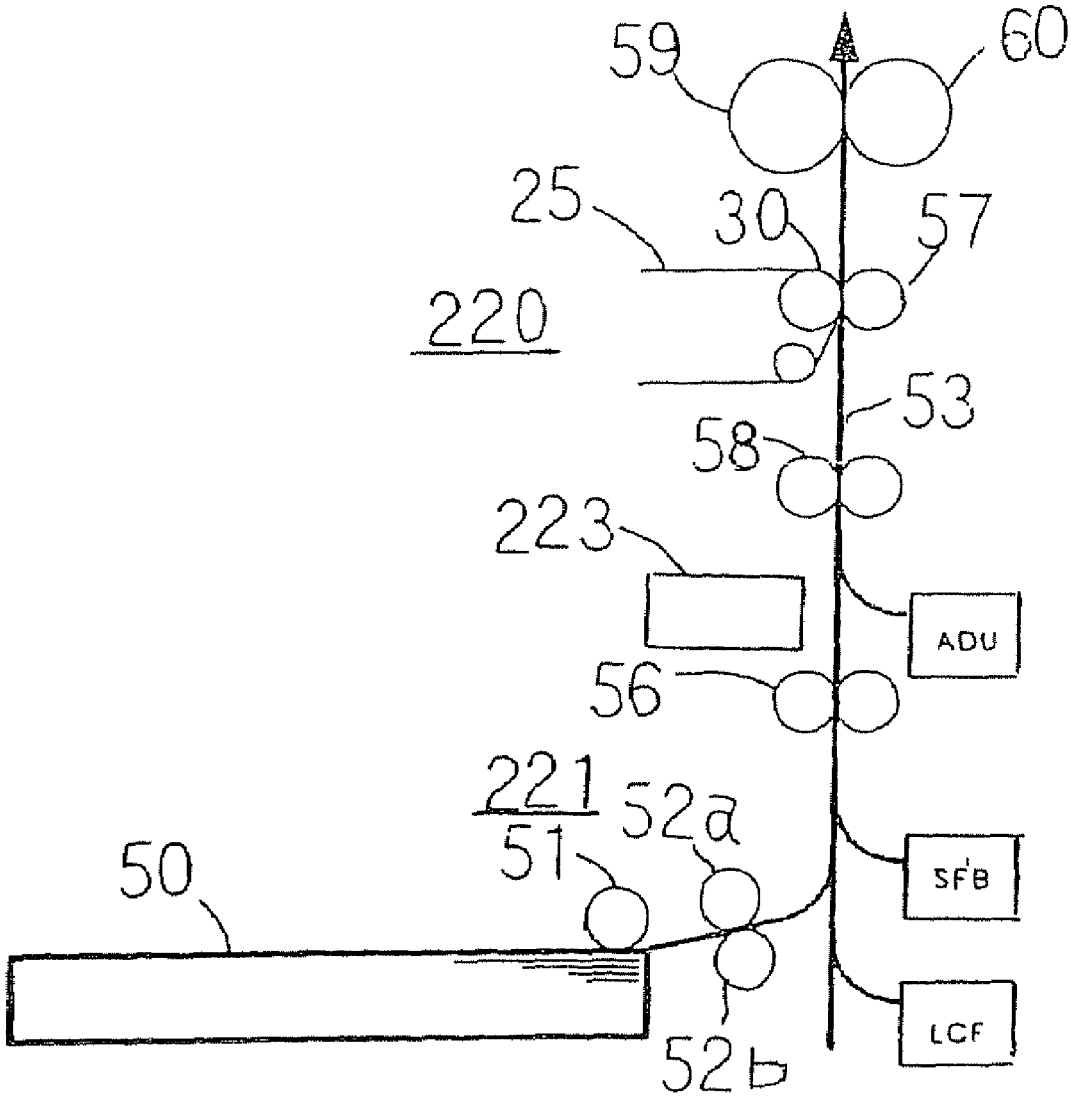
FIG. 3 is a partially enlarged view for explaining a sensor setting state in the first embodiment of the invention.

Reference numeral 223 denotes a paper type sensor, which is arranged on the upstream side with respect to the image forming unit 220 on the main paper conveying path 53 (a position further on the upstream side than the registration rollers 58) and detects a type of paper conveyed by the paper conveying path 53. FIG. 3 is schematically shows the main paper conveying path 53 section in FIG. 1 extracted and enlarged. In FIG. 3, a positional relation among the paper type sensor 223, the registration rollers 58, and joining points on the main paper conveying path 53 is clearly shown. As this paper type sensor 223, a publicly known sensor that discriminates a paper type by detecting the thickness and luminous transmittance of paper only has to be used.

In an example in FIG. 1, the two paper feeding cassettes 50 are provided as paper feeding sources. However, it goes without saying that the number of paper feeding cassettes 50 may be three or more. Besides, although not shown in the figure, a manual paper feeding mechanism (hereinafter referred to as SFB) and a large capacity paper feeder (hereinafter referred to as LCF) capable of stacking and feeding several thousand pieces of paper are used. Paper feeding paths from the SFB and LCF also join with the main paper conveying path 53. The paper type sensor 223 is arranged further on the downstream side than joining points of the paper feeding paths from the paper feeding sources SFB and LCF. Therefore, it is possible to detect, with one paper type sensor 223, all types of paper fed from the respective paper feeding sources and conveyed on the main paper conveying path 53.

A cleaner 36 is provided across the transfer belt 25 in a position opposed to the driver roller 26 of the image forming unit 220. This cleaner 36 has a cleaning blade 36*a*, which comes into contact with the transfer belt 25, and scrapes off a developing material remaining on the transfer belt 25 with the cleaning blade 36*a*. Hooks 71, 72, 73, and 74 are provided near the primary transfer rollers 41, 42, 43, and 44. These hooks 71, 72, 73, and 74 can engage with shafts of the primary transfer rollers 41, 42, 43, and 44 and lift the shafts while rotating and move the primary transfer rollers 41, 42, 43, and 44 in an upward direction in the figure. It is possible to set a full color mode, a fully separated mode, and a monochrome mode according to which ones (one) of the primary transfer rollers 41, 42, 43, and 44 are lifted.

A control circuit for the apparatus main body 1 will be explained using FIG. 2. Reference numeral 200 denotes a main controller. A control panel controller 201, a scan controller 202, and a print controller 210 are connected to the main controller 200. The main controller 200 collectively controls the control panel controller 201, the scan controller 202, and the print controller 210.

The scan unit 203 is connected to the scan controller 202. As described above, the scan unit 203 is constituted by the carriage 4, the exposure lamp 5, the reflecting mirrors 6, 7, and 8, the lens block for magnification 9, the CCD 10, and the like and optically scans an image of an original placed on the original stand 2.

The print controller 210 is connected to the paper type sensor 223 and is connected to a ROM 211 for control program storage, a RAM 212 for data storage, the print engine 213, the process unit 214, and a conveying unit 215, respectively. As described above, the print engine 213 is constituted by the exposing unit 11 and the like. As described above, the process unit 214 is constituted by the photoconductive drums 21, 22, 23, and 24, the transfer belt 25, the drive roller 26, the transfer-roller driving unit, and the like. The conveying unit 215 is constituted by conveying mechanisms, driving circuits for the conveying mechanisms, and the like in the paper conveying paths 53 and 62.

As shown in FIG. 2, the print controller 210 has a condition setting unit 210*a*, a process control unit for image formation 210*b*, and a paper-conveying-path control unit 210*c* as functions.

The condition setting unit 210*a* optimally sets conditions for the image forming unit 220 (the process unit 214 in FIG. 2 is equivalent to the image forming unit 220) in accordance with a detection result of the paper type sensor 223.

The process control unit for image formation 210*b* controls start of the image forming process in the image forming unit 220 according to whether a type of paper fed from the paper feeding cassette 50 to the main paper conveying path 53 by the paper feeding mechanism 221 is detected by the paper type sensor 223. When a paper type is not detected yet, the process control unit for image formation 210*b* does not start the image forming process. On the other hand, when a paper type is already detected (for example, when remaining pieces of paper are fed from the same cassette), the process control unit for image formation 210*b* can start the image forming process without awaiting paper type detection.

When the paper P is fed to the paper conveying path 53 by the paper feeding mechanism 221, the paper-conveying-path control unit 210*c* controls the paper conveying path 53 to convey this paper to the paper discharging unit 55. The paper-conveying-path control unit 210*c* controls the registration rollers 58 to convey paper, which is conveyed by the paper conveying path 53, to the image forming unit 220, in which the image forming process is started, in synchronization with a printing operation of the image forming unit 220.

In the constitution described above, for example, when one of the paper feeding cassettes 50 stores one new paper type and is set in the apparatus main body 1, the paper type of the paper P stored in this paper feeding cassette 50 is not detected by the paper type sensor 223 yet. In this state, when a paper feeding command is issued to perform printing on the paper in the paper feeding cassette 50, in which this undetected paper type is stored, the paper feeding mechanism 221 corresponding to this paper feeding cassette 50 feeds one piece of the paper P in the paper feeding cassette 50 to the main paper conveying path 53.

The paper-conveying-path control unit 210*c* causes the conveying roller 56 to rotate and convey the paper P fed to the paper discharging unit 55. In the middle of this conveyance, a paper type of the paper P is detected by the paper type sensor 223.

When a paper type of the paper fed to the main paper conveying path 53 is not detected yet as described above, the process control unit 210*b* does not start the image forming process in the image forming unit 220. At this point, since the main paper conveying path 53 continues to convey the paper fed, the paper passes through the image forming unit 22, in which the image process is not started, and is directly discharged to the paper discharging unit 55.

When a paper feeding command is issued for paper stored in the paper feeding paper cassette 50 same as the paper, the paper type of which is detected as described above, the process control unit 210*b* determines that the paper fed this time is paper of the same type as the paper, the paper type of which is already detected by the paper type sensor 223. At this point, since conditions for the image forming unit 220 are optimally set according to the paper type already detected, the process control unit 210*b* starts the image forming process without awaiting paper type detection. In this case, the paper-conveying-path control unit 210*c* controls the registration roller 58 to deliver the paper to the image forming unit 200 in synchronization with a printing operation of the image forming unit 220. At this point, since the image forming process is already started, printing based on image data is promptly performed in the image forming unit 220.

As described above, in the image forming apparatus according to the first embodiment of the invention, in the case in which a paper type is not detected yet, when first piece of paper is fed to the main paper conveying path 53, the paper is preliminarily passed to the paper discharging unit 55 while a paper type thereof is detected in the middle of the preliminary paper passage. In other words, a paper type is detected by the paper type sensor 223 in a process of the preliminary paper passage. Therefore, at a stage when second and subsequent pieces of paper are fed to the main paper conveying path 53, since the image forming process is optimally set and the image forming process is started according to this paper feeding, it is possible to promptly perform printing under optimum conditions and realize high performance.

Since the paper preliminarily passed for paper type detection is discharged, unlike in the past, paper, a paper type of which is already detected, does not stop in the middle of paper feeding because of an instruction for feeding of paper of another paper type and hinder feeding and conveyance of another piece of paper and it is unnecessary to once return the paper to a feeding source to prevent this hindrance. Therefore, a structure is simplified and it is possible to prevent occurrence of a paper jam and the like and perform smooth printing.

Since the paper preliminarily passed for paper type detection and discharged is not printed yet, it is possible to use the paper again as paper for printing and no waste occurs.

An image forming apparatus according to a second embodiment of the invention will be explained. An image detecting apparatus according to the second embodiment returns paper preliminarily passed for paper type detection to the upstream side of the image forming unit 220 using the automatic duplex unit 222 without discharging the paper and continuously executes printing.

Therefore, the paper-conveying-path control unit 210*c* of the print controller 210 is configured to, when paper fed to the main paper conveying path 53 by the paper feeding mechanism 221 is paper, a paper type of which is not detected by the sensor 223, actuate the sub paper conveying path 62 of the automatic duplex unit 222. The process control unit 210*b* is configured to, when paper fed to the main paper conveying path 53 by the paper feeding mechanism 221 is paper not detected by the sensor 223, not start the image forming process but start the image forming process when the sub paper conveying path 62 is actuated as described above.

In the constitution described above, in the case in which one of the paper feeding cassettes 50 stores a new paper type and is set in the apparatus main body 1, when a paper feeding command for printing is issued for the paper P stored in this paper feeding cassette 50, the paper feeding mechanism 221 feeds paper from the paper feeding cassette 50 to the main paper conveying path 53. When one piece of paper is fed to the main paper conveying path 53 in this way, the paper-conveying-path control unit 210*c* causes the conveying roller 56 to rotate and convey the paper P fed to the paper discharging unit 55. A paper type of the paper P is detected by the paper type sensor 223 in the middle of this conveyance.

The condition setting unit 210*a* optimally sets, in accordance with a detection result of the paper type sensor 223, conditions for the image forming process of the image forming unit 220 to match a paper type detected. On the other hand, since a paper type of the paper fed to the main paper conveying path 53 is not detected yet, the process control unit 210*b* does not start the image forming process in the image forming unit 220. However, since the main paper conveying path 53 is continuing to convey the paper fed, the paper passes through the image forming unit 220 in which the image process is not started.

At this point, since the paper-conveyance controlling means 210*c* actuates the sub paper conveying path 62 of the duplex automatic unit 223, the sub paper conveying path 62 catches the paper conveyed from an exit of the image forming unit 220 to the paper discharging unit 55 and switches back the paper. Therefore, paper preliminarily passed is joined to the upstream side of the image forming unit 220 while the front and the back thereof are reversed. The process control unit 210*b* has started the image forming process because the sub paper conveying path 62 is actuated. The paper-conveyance controlling means 210*c* controls the registration roller 58 to convey the paper returned to the upstream side of the image forming unit 220 as described above to the image forming unit 220, in which the image forming process is started, in synchronization with print timing of the image forming process. Therefore, predetermined printing is applied to the paper preliminarily passed by the image forming unit 220.

As described above, when a paper feeding command for printing is given to the paper feeding cassette 50, if a paper type of the paper feeding cassette is not detected yet, a first piece of paper is preliminarily passed and a paper quality of the paper is detected, and, then, the paper is returned to the upstream side of the image forming unit 220 by the sub paper conveying unit 62 without being discharged. Thus, it is possible to perform printing with the image forming process optimally set according to the paper quality detected.

As in the first embodiment, concerning second and subsequent pieces of paper, the image forming process is started without awaiting paper type detection and printing based on image data is promptly performed in the image forming unit 220 under optimum conditions.

In this second embodiment, as in the first embodiment, unlike in the past, paper preliminarily passed does not stop in the middle of paper feeding and hinder feeding and conveyance of another piece of paper and it is unnecessary to once return the suspended paper to a feeding source to prevent this hindrance. Since the existing duplex automatic unit 222 is used, it is possible to perform printing on the paper preliminarily passed without providing a new mechanism.

What is claims is:

1. An image forming apparatus comprising:

a paper feeding mechanism that feeds paper piece by piece;

a paper conveying path that conveys, when paper is fed by this paper feeding mechanism, this paper to a paper discharging unit;

an image forming unit configured to be arranged between the paper feeding mechanism and the paper discharging unit on this paper conveying path and execute an image forming process for printing an image based on image data on the paper being conveyed by the paper conveying path;

a sensor that is arranged on an upstream side with respect to the image forming unit on the paper conveying path and detects a type of paper conveyed by this paper conveying path;

a condition setting unit configured to set conditions for an image forming process of the image forming unit in accordance with a value detected by this sensor;

an image-forming-process control unit configured to not start the image forming process when paper fed to the paper conveying path by the paper feeding mechanism is the paper not detected by the sensor and start the image forming process without awaiting paper type detection when paper fed to the paper conveying path is detected by the sensor; and a paper-conveying-path control unit configured to cause, when paper fed to the paper conveying path is the paper not detected by the sensor, the paper conveying path to discharge the paper through the image forming unit, in which the image forming process is not started, and cause, when paper fed to the paper conveying path is paper of a type same as paper detected by the sensor, the paper conveying path to convey the paper to the image forming unit, in which the image forming process is started, in synchronization with a printing operation of the image forming unit.

2. An image forming apparatus according to claim 1, wherein the paper conveying path is constituted by joining paper feeding paths from plural paper feeding sources, and the sensor is arranged further on a downstream side than this joining point.

3. An image forming apparatus according to claim 1, wherein the paper conveying path is constituted by joining paper feeding paths from plural paper feeding sources, the sensor is arranged further on a downstream side than this joining point, and the image-forming-process control unit determines that paper fed from a paper feeding source same as a paper feeding source of the paper detected by the sensor to the paper conveying path is a same type of paper and starts the image forming process without awaiting paper type detection.

4. An image forming apparatus comprising:

a paper feeding mechanism that feeds paper piece by piece;

a main paper conveying path that conveys, when paper is fed by this paper feeding mechanism, the paper to a paper discharging unit;

an image forming unit configured to be arranged between the paper feeding mechanism and the paper discharging unit on this main paper conveying path and execute an image forming process for printing an image based on image data on the paper being conveyed by the main paper conveying path;

a sensor that is arranged on an upstream side with respect to the image forming unit on the main paper conveying path and detects a type of paper conveyed by this main paper conveying path;

a sub paper conveying path that is divided from a downstream side with respect to the image forming unit on the main paper conveying path, joins with the upstream side with respect to the image forming unit on the main paper conveying path, and, in operation, switches back paper conveyed from the image forming unit to the paper discharging unit and joins the paper to the upstream side of the image forming unit;

a condition setting unit configured to set conditions for an image forming process of the image forming unit in accordance with a value detected by this sensor;

an image-forming-process control unit configured to not start the image forming process when paper fed to the main paper conveying path by the paper feeding mechanism is the paper not detected by the sensor and start the image forming process according to the paper feeding to the main paper conveying path when paper fed to the paper conveying path is paper of a type same as paper detected by the sensor; and a paper-conveying-path control unit configured to convey, when paper fed to the main paper conveying path is the paper not detected by the sensor, the paper to the sub paper conveying path, start the image forming process, and cause the sub paper conveying path to convey the paper conveyed through the sub conveying path to the image forming unit, in which the image forming process is started, in synchronization with a printing operation of the image forming unit and cause, when paper fed to the paper main conveying path is paper of a type same as paper detected by the sensor, the main paper conveying path to convey the paper to the image forming unit, in which the image forming process is started, in synchronization with a printing operation of the image forming unit.

5. An image forming apparatus according to claim 4, wherein the main paper conveying path is constituted by joining paper feeding paths from plural paper feeding sources, and the sensor is arranged further on a downstream side than this joining point.

6. An image forming apparatus according to claim 4, wherein the main paper conveying path is constituted by joining paper feeding paths from plural paper feeding sources, the sensor is arranged further on a downstream side than this joining point, and the image-forming-process control unit determines that paper fed from a paper feeding source same as a paper feeding source of the paper detected by the sensor to the main paper conveying path is a same type of paper and starts the image forming process without performing paper type detection.

7. A control method of an image forming apparatus comprising the steps of:

feeding paper piece by piece to a paper conveying path that conveys fed paper to a paper discharging unit;

detecting a type of the paper fed to the paper conveying path with a sensor;

setting, in accordance with a detection result of the sensor, image forming process conditions for an image forming unit that executes an image forming process for forming an image based on image data and printing the image on paper being conveyed by the paper conveying path;

not starting the image forming process of the image forming unit when paper fed to the paper conveying path is paper, a type of which is not detected by the sensor, and discharging the paper through the image forming unit, in which the image forming process is not started; and starting the image forming process without performing paper type detection when paper fed to the paper conveying path is paper of a type same as paper, a type of which is detected by the sensor, and causing the paper conveying path to convey the paper to the image forming unit, in which the image forming process is started, in synchronization with a printing operation of the image forming unit.

8. A control method of an image forming apparatus comprising the steps of:

feeding paper piece by piece to a main paper conveying path that conveys fed paper to a paper discharging unit;

detecting a type of the paper fed to the main paper conveying path with a sensor;

setting, in accordance with a detection result of the sensor, image forming process conditions for an image forming unit that executes an image forming process for forming an image based on image data and printing the image on paper being conveyed by the paper conveying path;

not starting the image forming process when paper fed to the paper main conveying path is paper, a type of which is not detected by the sensor, passing the paper through the image forming unit, in which this image forming process is not started, actuating a sub paper conveying path that is divided from an exit side of this image forming unit and joins with an upstream side with respect to the image forming unit of the main paper conveying path, switching back paper conveyed from the image forming unit to the paper discharging unit, joining the paper to the upstream side of the image forming unit, starting the image forming process, and conveying the paper to the image forming unit in synchronization with printing timing of the image forming unit; and starting the image forming process without performing paper type detection when paper fed to the main paper conveying path is paper of a type same as paper detected by the sensor and causing the main paper conveying path to convey the paper to the image forming unit in synchronization with a printing operation of the image forming unit.

* * * * *